US011810683B2

(12) United States Patent
Kar et al.

(10) Patent No.: US 11,810,683 B2
(45) Date of Patent: Nov. 7, 2023

(54) RADIATION SHIELD

(71) Applicant: Elopar Elektrik Ve Otomotiv Parçalar Sanayi Ve Ticaret Anonim Sirketi, Istanbul (AR)

(72) Inventors: Anil Kar, Istanbul (TR); Mehmet Sandal, Istanbul (TR)

( * ) Notice: Subject to any disclaimer, the term of this patent is extended or adjusted under 35 U.S.C. 154(b) by 475 days.

(21) Appl. No.: 17/279,721

(22) PCT Filed: Nov. 30, 2018

(86) PCT No.: PCT/TR2018/000115
§ 371 (c)(1),
(2) Date: Mar. 25, 2021

(87) PCT Pub. No.: WO2020/068006
PCT Pub. Date: Apr. 2, 2020

(65) Prior Publication Data

US 2021/0398702 A1 Dec. 23, 2021

(51) Int. Cl.
*G21F 1/10* (2006.01)

(52) U.S. Cl.
CPC ..... *G21F 1/103* (2013.01)

(58) Field of Classification Search
CPC ..... G21F 1/103
See application file for complete search history.

(56) References Cited

U.S. PATENT DOCUMENTS

2015/0287485 A1 10/2015 Kale et al.

FOREIGN PATENT DOCUMENTS

EP 1020874 A1 7/2000
TR 201707064 5/2017

OTHER PUBLICATIONS

International Search Report for corresponding PCT/TR2018/000115, dated Nov. 29, 2019.
Written Opinion of the International Searching Authority for corresponding PCT/TR2018/000115, dated Nov. 29, 2019.
Hou et al. "Gamma Ray Shielding Property of Tungsten Powder Modified Continuous Basalt Fiber Reinforced Epoxy Matrix Composites", Polymer Composites—2017 Doi 10.1002/pc.
Jia et al. "Cerium doped barium tantalates: Fabrication, characterization, and investigation of gamma radiation attenuation", Journal of Allows and Compounds 688, Jul. 25, 2016, pp. 679-684.
Dong et al. "Effects of WO3 Particle Size in WO3/Epoxy Resin Radiation Shielding Material", Chin. Phys. Lett. Vol. 29, No. 10 (2012).
Li et al., "Effect of particle size on gamma radiation shielding property of gadolinium oxide dispersed epoxy resin matrix composite", 2017 Mater. Res. Express 4 035035.
Li et al. "Radiation shielding property of structural polymer composite: Continuous basalt fiber reinforced epoxy matrix composite containing erbium oxide", Composites Science and Technology (2017), doi: 10.1016/j.compscitech.2017.03.002.

*Primary Examiner* — Nicole M Ippolito
*Assistant Examiner* — Hanway Chang
(74) *Attorney, Agent, or Firm* — Egbert, McDaniel & Swartz, PLLC

(57) ABSTRACT

Disclosed is radiation-retarding radiation shield which is more flexible than non-toxic lead and lead alloy structures and does not disturb the user.

2 Claims, No Drawings

RADIATION SHIELD

TECHNICAL FIELD

The present invention relates to a radiation-retarding radiation shield which is more flexible than non-toxic lead and lead alloy structures and does not disturb the user.

PRIOR ART

Today, radiation, i.e. x-rays are used in many fields. X-rays are located in the electromagnetic spectrum between gamma rays and ultraviolet rays. X-rays have some known negative effects on human DNA, that is to say that they cause mutation in human DNA and cause tumor growth in living tissues. However, the energies of x-rays are reduced to provide useful services in fields such as medicine and crystallography. However, workers who are exposed to low-energy x-ray in medicine field use various protective armor with thick and heavy structural features made of materials in which lead (Pb) and its compounds are present, in order not to be affected by bad conditions such as cancer in the future. Although lead (Pb) has the ability to inhibit x-rays due to its structure, the harmful effects of lead (Pb) on human and environment are known. For these reasons, there is a need for radiation shields made of a non-toxic and flexible structure having a characteristic that does not contain lead (Pb) and its compounds but which have no x-ray permeation of lead (Pb).

Pb (lead) content is generally used in the studies carried out in the prior art and the production of alloy or unalloyed radiation shielding material is carried out due to the density. Shields in question are not useful as they are heavy as well as inflexible. Some of the previous solutions are nano doped PbO. Since nanocrystalline Pb atoms or their oxidized components provide better protection than the microstructure, such samples or Pb or PbO containing compound as well as more than one oxide metal alloys have been formed to reduce the existing Pb ratio in order to reduce the existing weight in the mixture. Besides this; Tungsten, Copper, Iron and similar structures with no lead content, but with equivalent weight, or similar alloys. are used with lead additive.

In the state of the art, Dong Yu (2012) et al. investigated the radiation shielding properties of nano-sized WO3 compound by adding it to the epoxy resin. Ran Lie developed the composite material to be radiation-retarding feature by adding the nano-size Gd2O3 compound into the epoxy resin. Besides, Ran Lie et al. showed that Er2O3-doped epoxy resin with basalt fiber is more effective in radiation shielding than aluminum (Al). Xiabing Jia et al., investigated the effects of the material produced by forming a matrix with $Ba_2Ta_4O_{15}$. ethylene propylene on the radiation reduction coefficient.

In the state-of-the-art technology according to the patent application no TR201707064, a material that shields x-ray and/or gamma radiation with the nano-size lead oxide particle and bismuth oxide additive to be used in the production of the equipment used by the employees against the radiation they are exposed to. The material comprising the nanoscale crystals of the lead oxide and bismuth oxide compounds mentioned in the invention is doped with a paste containing various chemicals. My mixing Pb and Bi elements in the material mentioned in the invention in different proportions to show how much millimeter the sample's thickness is and and how many percent of the radiation is attenuated is shown. However, the invention does not mention the use of soil group compounds instead of using lead and compounds in the composite sample obtained.

SHORT DESCRIPTION OF INVENTION

The object of the present invention is to provide a radiation shield made of composite material that does not physically disturb the user, such as sweating during application, due to its flexible structure and which does not cause any harm to the user.

Another object of the present invention is to provide a radiation shield which is not as toxic as the lead, thus providing full protection against human and environment.

Another object of the present invention is to provide a radiation shield made of a composite material which is easy to process and which does not have a fragile property because it does not have a rigid structure in terms of production value added.

DETAILED DESCRIPTION OF INVENTION

A radiation shield according to the invention is made of a basalt fiber doped polymer or a non-doped polymer, Ba or Bi-based ceramic matrix and a high atomic number element doped composite material.

The high atomic element additive used in the production of radiation shield is produced in nano-crystal size or micro additive form. The plastic to be used is polymer or copolymer.

Compounds used in the production of radiation shielding according to the invention are ready for a certain period of mixing operation and a two-stage thermal treatment period with a pH value of about 4.8 to 6.3 in the range of chemicals containing bismuth and molybdenum. The composition was completed in such a way that the thermal treatment temperatures were between 70 and 950° C. The total duration of the experiment is between 2-20 hours. Also, the contents themselves and their compositions were evaluated in the studies.

The use of the composite material in hand of the radiation shield of the present invention is due to the fact that it is both flexible and non-toxic content. The composite material used in the shield is formed with the content of additive ratio up to 85%. The radiation shield provides approximately 94%-97% retention up to 80 kV energy, while the armoring occurs within the energy range of 89% to 93% within the 100 kV energy range.

It is possible to develop various applications for the radiation shield according to the invention, it may not he limited to examples described here, it is essentially as described in claims.

The invention claimed is:

1. A radiation shield, comprising a basalt fiber doped polymer or a non-doped polymer, Ba or Bi-based ceramic matrix and a high atomic number element doped composite material.

2. The radiation shield of claim 1, further comprising a high atomic number element in nano-crystal size or microstructure additive.

* * * * *